United States Patent [19]

Hodge

[11] Patent Number: 4,520,945

[45] Date of Patent: Jun. 4, 1985

[54] SOLID WASTE RECEPTACLE SECURITY SYSTEM

[76] Inventor: Allan M. Hodge, 5852 Lomond Dr., San Diego, Calif. 92120

[21] Appl. No.: 590,697

[22] Filed: Mar. 19, 1984

[51] Int. Cl.[3] ..... B65D 45/00

[52] U.S. Cl. ..... 220/315; 220/1 T

[58] Field of Search ..... 220/1 T, 315, 210; 294/73, 68, 69 R; 292/228, 281, 288; 214/302–304, 307, 317

[56] References Cited

U.S. PATENT DOCUMENTS

| | | | |
|---|---|---|---|
| 4,182,530 | 1/1980 | Hodge | 294/73 |
| 4,342,402 | 8/1982 | Jungles | 220/1 T |
| 4,445,623 | 5/1984 | Kohling et al. | 220/1 T |

*Primary Examiner*—George T. Hall

*Attorney, Agent, or Firm*—Poms, Smith, Lande & Rose

[57] ABSTRACT

A trash bin may be provided with one or more lids which are made of plastic or flexible metal material. These lids are provided with locking arrangements toward the front center portion of each lid which mate with corresponding adjacent locking mechanisms on the trash bin. A rigid, plastic reinforcing rod is provided within the lid toward its front edge and extending outwardly toward the front corners of the lid to prevent the lid being flexed or bent and opened, notwithstanding the locking mechanism. The center of the reinforcing rod may be secured at the inner center toward the front of the lid to a reinforcing plate which may in turn be secured to the locking mechanism on the outside of the lid. The locking mechanism may include a plurality of locks, in order to permit separate access by more than one party. In addition, the locking mechanisms may be arranged to snap into the locked position, so that a key actuation is not required for locking.

18 Claims, 6 Drawing Figures

SOLID WASTE RECEPTACLE SECURITY SYSTEM

FIELD OF THE INVENTION

This invention relates to locking arrangements for trash bins, particularly larger trash bins of the commercial type.

BACKGROUND OF THE INVENTION

In my prior U.S. Pat. No. 4,182,530, granted Jan. 8, 1980, I disclosed locking arrangements for rigid trash bins to prevent the unauthorized use of the bins. In recent years, however, plastic lids for trash bins have become more popular and are being more widely used. For many applications it is not necessary or desirable to providing locking arrangements for trash bins, and accordingly, the plastic lids are made of material which is sufficiently lightweight that it may be flexed or bent to a considerable degree if pressure is applied to one corner of the lid while the remainder of the lid is held down. Accordingly, up to the present time, it has not been practical to provide effective locks for trash bins which are provided with flexible lids, either of the new plastic type, or those made with relatively light gauge metal lids. Accordingly, an important object of the present invention is to provide secure locking arrangements for trash bins having relatively flexible lids.

Another problem in the locking of trash bins has been the nature of the locks which have been proposed heretofore. In general, they have been somewhat more expensive than might be desirable, and may not have the adaptability which is useful in many situations. Accordingly, another object of the present invention is to provide improved locking arrangements for trash bins.

SUMMARY OF THE INVENTION

In accordance with one specific illustrative embodiment of the invention, a trash bin having flexible lids or a flexible lid, is provided with a central locking arrangement toward the front and center of the lid, and a mating or cooperating locking arrangement mounted nearby on the trash can. Within the lid and extending along the front of the lid to points near each of the front corners of the lid is a reinforcing bar which is secured in place, and which precludes the unauthorized use of the trash bin which might otherwise be accomplished by raising a corner of the (otherwise) flexible lid. The locking mechanism on the lid also preferably serves as a central support for the reinforcing rod, with mating units on the inside and outside of the lid being secured together. The locking arrangements may be in the form of a cable, having a plurality of locking arrangements so that access by more than one person on an independent basis is convenient; and cabling is preferably used in the interconnection of the locking arrangements on the lid with those on the trash can.

In accordance with another aspect of the present invention, plastic or non-ferrous reinforcing rods of moderate rigidity are secured within and along the front or side edges of the flexible lids of trash bins, and the trash bin lid is provided with locking arrangements to secure it to the bin in a locked state.

In accordance with another aspect of the invention, a plurality of locking arrangements are provided for securing trash bin lids into position in the locked state, so that, for example, the owner or renter of the bin may have sole user access, but the trash collector may have a master key which opens each trash bin which he services.

Other objects, features and advantages of the invention will become apparent from a consideration of the following detailed description and from the accompanying drawings.

DETAILED DESCRIPTION

Figure 1:
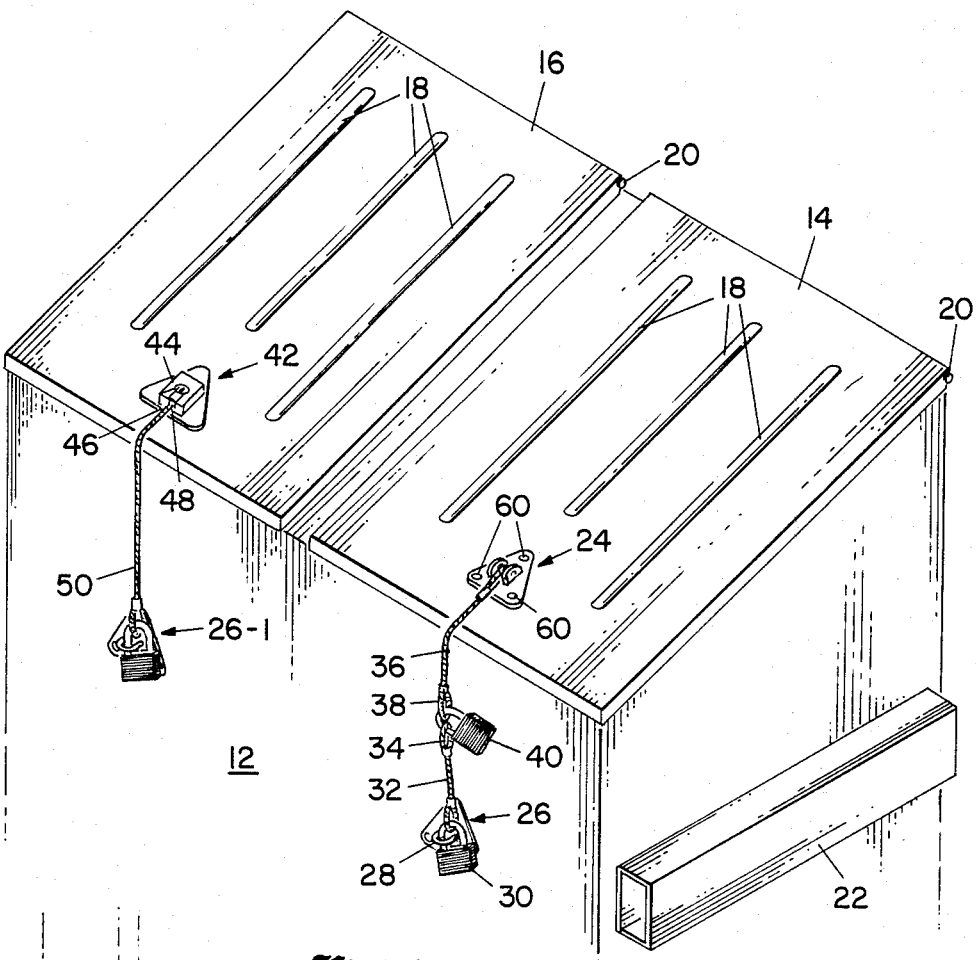
FIG. 1 is an overall view of a trash bin including flexible lids and locking arrangements illustrating the principles of the invention.

Referring more particularly to the drawings, FIG. 1 shows a trash bin 12 provided with two plastic lids 14 and 16. Each of these lids is provided with reinforcing ribs 18 to give them additional strength. The lids are pivoted along the line indicated by reference numeral 20 at the upper rear corner of the bin 12. The trash bin may be provided with lifting pockets 22, if desired, in order to facilitate their dumping by compactor trucks or the like.

Now, referring to the locking arrangements, in order to show the various alternatives which are contemplated in accordance with the present invention, different locking arrangements have been provided for lid 14, as compared with lid 16. It is of course to be understood, that, in practice a single type of lock would normally be employed on both lids for convenience of manufacture and the like.

For securing the lid 14 in place, a bracket assembly 24 is mounted toward the front and center of lid 14. Secured to the front of the bin 12 near the lid 14 is a locking assembly 26 including a metal loop 28 and a padlock 30 which is looped through both the metal loop 28 and a loop formed at the end of the steel cable 32. The steel cable 32 is provided with a second loop 34, and is coupled to a second cable 36 having a loop 38 by a padlock 40. The other end of the steel cable 36 is securely fastened to the bracket 24 in a manner to preclude easy release. The units 24 and 26 may be bolted onto the lid 14 and the trash bin 12 by suitable bolts, as indicated, and a matching plate may be provided within the lid, as noted below. Preferably these bolts will be smooth, as to their exposed heads, to preclude easy removal.

The lid 16 is secured in place onto the bin 12 by alternative arrangements including a bracket 26-1 which corresponds in all significant respects to the assemblies on the bin 12 adjacent the front central edge of lid 14. Mounted on the front central area of the lid 16, however, is a locking assembly of the type shown in greater detail in FIG. 3. More specifically, this assembly 42 includes a key receptacle 44 and a locking slot 46 for receiving a latching mechanism 48 which is secured to the upper end of a cable 50, which is in turn secured by a padlock 30-1 at its other end to the assembly 26-1. This assembly will be described in greater detail in connection with FIGS. 3 and 4.

Figure 2:
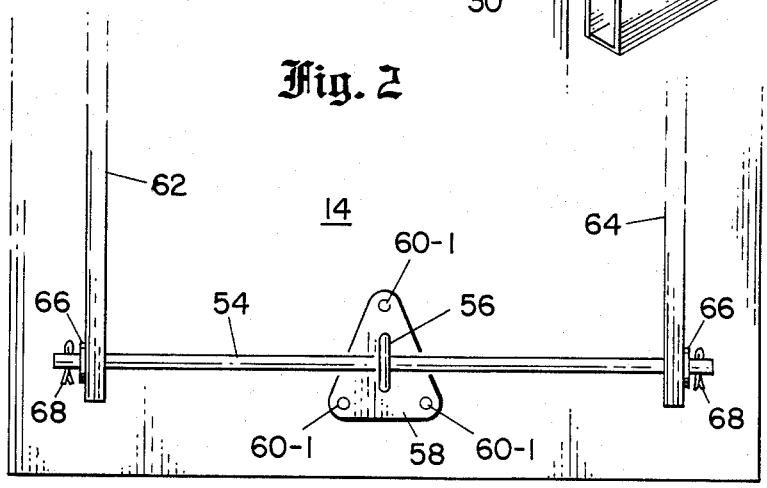
FIG. 2 is a view of the inside front of the lid of a trash bin showing a reinforcing rod mounted in place.

Referring now to FIG. 2, a reinforcing rod 54 is secured through the metal loop 56 on the plate 58 which has a matching plate 24 mounted on the front center portion of the lid 14. More specifically, the bolts 60 which are visible in FIG. 1 extend through to the plate 58 where the hex nuts 60-1 hold the bolts 60 and firmly clamp the lid 14 between the two plates 24 and 58. The rod 54 may extend through the ribs 62 and 64 on the inside of the lid 14, and may be secured in place by washers 66 and cotter pins 68.

Figure 5:
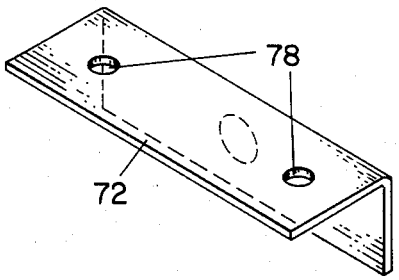
FIGS. 5 and 6 are alternative views of a bracket which may be employed in the course of securing a reinforcing rod to the inner front edge of a flexible lid.
Figure 6:
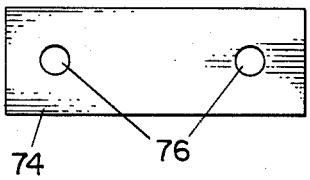

In the event that ribs are not available conveniently for the mounting of the reinforcing rod 54, appropriate brackets 72 and 74 as shown in FIGS. 5 and 6, may be employed. Incidentally, the brackets 72 would be mounted inside the lid, and the bracket 74 would be mounted on the exterior thereof, with bolts extending from the holes 76 in plates 74 through holes 78 in the brackets 72.

Figure 3:
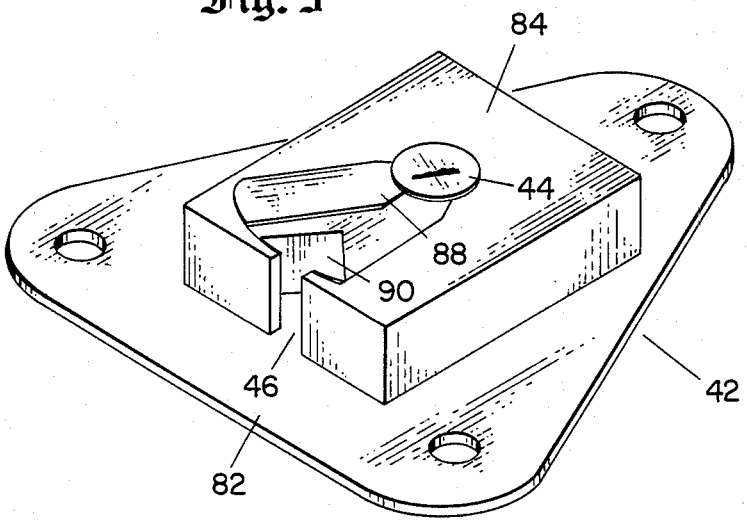
FIG. 3 is an enlarged showing of one locking mechanism which may be employed in the implementation of the present invention.
Figure 4:
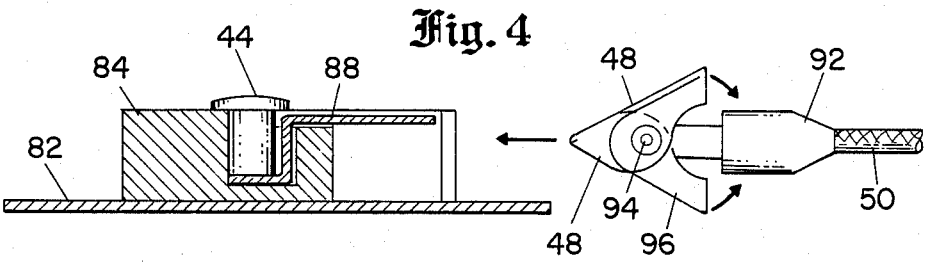
FIG. 4 is a more detailed showing of locking parts which may be employed in the unit of FIG. 3.

Now, turning to FIGS. 3 and 4, an alternative locking mechanism 42 is disclosed. It includes a plate 82 and a cam lock assembly 84 having a keyhole 44 and a movable locking plate 88 which may be selectively moved away from its locking position which covers the top of the arrow shaped locking recess 90. Referring to FIG. 4, the cable 50 is provided with an end member 92 to which is secured a pair of latching members 48 which form an assembly similar to an arrowhead. These members 48 are pivoted at point 94 and are spring biased to the outer position as shown by the leaf spring 96. Accordingly, even when the locking cam member 88 covers the recess 90, the locking members 48 may be inserted into the front area 46 of the assembly 84 and make locking engagement therewith, without the need for using a key in the key recess 44.

For completeness, it may be noted that commercial trash bins come in a number of standard sizes. One of these sizes is 6 feet wide by 4 feet from front-to-back, and with each of the two lids being about 3 feet wide by about 4 feet from front-to-back. As mentioned previously, the reinforcing rods are preferably made of a stiff high strength plastic rod stock in the order of $\frac{5}{8}$ inch in diameter. It is understood that the invention is applicable to trash bins of various sizes and dimensions. Steel rods are not satisfactory for reinforcing as they are too heavy, rust upon exposure to moisture and the like, and become permanently bent in the event of forcing of the lid. On the other hand, the stiff high strength plastic rod stock has none of these problems.

In conclusion, it is to be understood that the foregoing detailed description and the accompanying drawings show one illustrative embodiment of the invention. Other arrangements could be employed to perform the same general functions, through the use of different types of mechanical mechanisms and locking arrangements. Thus, by way of example and not of limitation, the commercial trash bin may be provided with one big lid instead of two smaller ones, and, with a longer rod extending along the inside front of the lid, a pair of locking mechanisms could be secured along the lid, perhaps twenty percent of the distance from eqch end of the lid. Further, reinforcing rods may be employed along the sides of the lids in addition to or instead of the single rod disclosed hereinabove. Also, when a pair of lids are employed, the two lids may be cabled together through a pair of metal loops secured to the bin near the middle of the front of each lid, so that a single unlocking step with either of two locks in the cable extent, will unlock both lids. Accordingly, the present invention is not limited to that precisely as shown and described hereinabove.

What is claimed is:

1. A locking trash bin assembly comprising:

a trash bin;

at least one lid for said trash bin, said lid being formed of relatively flexible material;

locking means secured to the front of each said lid and to the front of said trash bin for preventing the opening of said lid; and non-ferrous reinforcing rod means secured to the inside of said lid toward the front thereof and extending toward the corners thereof, to prevent deformation or flexing of said lid and opening thereof while said lid is locked.

2. A locking trash bin assembly as defined in claim 1 wherein said locking means include a cable.

3. A locking trash bin assembly as defined in claim 1 wherein said locking means includes at least two separate locks, whereby different persons may have indpendent access to opening said lid.

4. A locking trash bin assembly as defined in claim 1 wherein said locking means includes at least one key operating locking mechanism.

5. A locking trash bin assembly as defined in claim 1 wherein said locking means includes a locking mechanism which is key operated to open and includes means for locking without a key.

6. A locking trash bin assembly as defined in claim 1 further comprising a reinforcing plate secured to the inside of the lid and to the locking means secured to the front of each lid, and means for securing the center of said reinforcing rod means to said reinforcing plate.

7. A locking trash bin assembly as defined in claim 1 including means for securing the ends of said reinforcing rods into the front corners of said lid.

8. A locking trash bin assembly as defined in claim 1 wherein said reinforcing rod is made of rigid high strength plastic material.

9. A locking trash bin assembly comprising:

a trash bin;

at least one lid for said trash bin, said lid being formed of relatively flexible material;

locking means including at least one steel cable secured to the front of each said lid on the outside of said lid, and to the front of said trash bin, for preventing the opening of said lid;

reinforcing rod means secured to the inside of said lid toward the front thereof and extending toward the corners thereof, to prevent deformation or flexing of said lid and opening thereof while said lid is locked;

said locking means including at least two separate locks, whereby different persons may have independent access to opening said lid;

said locking means further including a locking mechanism which is key operated to open and includes means for locking without a key;

a reinforcing plate secured to the inside of the lid and to the locking means secured to the front of each lid, means for securing the center of said reinforcing rod means to said reinforcing plate; and means for securing the ends of said reinforcing rods into the front corners of said lid.

10. A locking trash bin assembly as defined in claim 9 wherein said reinforcing rod is made of rigid high strength plastic material.

11. A locking trash bin assembly comprising:

a trash bin;

at least one lid for said trash bin, said lid being formed of relatively flexible material;

locking means mounted on the outer surface of each said lid and to said trash bin adjacent the edge of said lid in proximity to the locking means mounted on said lid for preventing the opening of said lid; and rigid plastic reinforcing rod means secured to the inside of said lid and extending toward the front corners thereof, to prevent deformation or flexing of said lid and opening thereof while said lid is locked.

12. A locking trash bin assmembly as defined in claim 11 wherein said locking means includes a cable.

13. A locking trash bin assembly as defined in claim 11 wherein said locking means includes at least two separate locks, whereby different persons may have independent accesss to opening said lid.

14. A locking trash bin assembly as defined in claim 11 wherein said locking means includes at least one key operating locking mechanism.

15. A locking trash bin assembly as defined in claim 11 wherein said locking means includes a locking mechansim which is key operated to open and includes means for locking without a key.

16. A locking trash bin assembly as defined in claim 11 further comprising a reinforcing plate secured to the inside of the lid and to the locking means secured to the front of each lid, and means for securing the center of said reinforcing rod means to said reinforcing plate.

17. A locking trash bin assembly as defined in claim 11 including means for securing the ends of said reinforcing rods into the front corners of said lid.

18. A locking trash bin assembly as defined in claim 11 wherein said reinforcing rod is secured along the front inner edge of said lid.

* * * * *